US008590141B2

(12) United States Patent
Hirano et al.

(10) Patent No.: US 8,590,141 B2
(45) Date of Patent: Nov. 26, 2013

(54) METHOD AND APPARATUS FOR MANUFACTURING METAL PLATE CHIP RESISTORS

(75) Inventors: Tatsuki Hirano, Ayase (JP); Kazuo Tanaka, Naie-cho (JP)

(73) Assignee: Kamaya Electric Co., Ltd., Ayase-shi (JP)

( * ) Notice: Subject to any disclaimer, the term of this patent is extended or adjusted under 35 U.S.C. 154(b) by 0 days.

(21) Appl. No.: 13/196,078

(22) Filed: Aug. 2, 2011

(65) Prior Publication Data

US 2011/0283522 A1 Nov. 24, 2011

Related U.S. Application Data

(63) Continuation of application No. 12/294,563, filed as application No. PCT/JP2008/050170 on Jan. 10, 2008, now abandoned.

(30) Foreign Application Priority Data

Aug. 30, 2007 (JP) ..... 2007-223746

(51) Int. Cl.
*H01C 17/00* (2006.01)

(52) U.S. Cl.
USPC ..... 29/610.1; 29/593; 29/705; 338/331

(58) Field of Classification Search
USPC ..... 29/610.1, 603.18, 620–621, 831, 830, 29/846–847, 592.1, 705, 593; 338/307–309, 331; 257/516
See application file for complete search history.

(56) References Cited

U.S. PATENT DOCUMENTS

| | | | | |
|---|---|---|---|---|
| 4,452,113 | A * | 6/1984 | Pearl | 83/56 |
| 5,806,171 | A * | 9/1998 | Wang | 29/612 |
| 5,828,123 | A | 10/1998 | Hirano | |
| 7,103,965 | B2 | 9/2006 | Tanimura | |
| 7,326,999 | B2 * | 2/2008 | Tsukada | 257/359 |
| 7,667,568 | B2 | 2/2010 | Tanimura et al. | |
| 2003/0172522 | A1 | 9/2003 | Tanimura | |
| 2005/0225424 | A1 | 10/2005 | Tsukada | |
| 2006/0097340 | A1 | 5/2006 | Tsukda et al. | |
| 2006/0205171 | A1 | 9/2006 | Tsukada | |

FOREIGN PATENT DOCUMENTS

| | | |
|---|---|---|
| JP | 2000-114009 | 4/2000 |
| JP | 2000-232009 | 8/2000 |
| JP | 2003-115401 | 4/2003 |
| JP | 2004-063503 | 2/2004 |

(Continued)

*Primary Examiner* — Peter DungBa Vo
*Assistant Examiner* — Kaying Kue
(74) *Attorney, Agent, or Firm* — Jason D. Voight

(57) ABSTRACT

The object of the invention is to provide a method and an apparatus that allow production of metal plate chip resistors having a relatively low resistance with high accuracy and yield through simple process. The object is achieved by apparatus 10 for manufacturing metal plate chip resistors including cutting mold 21 for cutting intermediate product strip 14 transversely to obtain worked product chip 16*a*, ohm meter 22 for measuring the resistance of the worked product chip 16*a*, control device 23 having a calculating part for performing a calculation using the resistance measured by the ohm meter 22 to work out a width in which the strip 14 is to be cut transversely so as to obtain a worked product chip of a desired resistance, and cutting width adjusting means 26, 27 for making an adjustment so that the strip 14 is to be cut transversely in the width obtained from the calculating part.

5 Claims, 3 Drawing Sheets

(56) References Cited

FOREIGN PATENT DOCUMENTS

| | | | |
|---|---|---|---|
| JP | 3525815 | | 5/2004 |
| JP | 3873819 | | 1/2007 |
| JP | 2007-103976 | | 4/2007 |
| WO | 2008/018219 | A1 | 2/2008 |

* cited by examiner (a)

(b)

METHOD AND APPARATUS FOR MANUFACTURING METAL PLATE CHIP RESISTORS

This is a Continuation of application Ser. No. 12/294,563, which is the National Stage of International Application PCT/JP2008/050170, filed Jan. 10, 2008.

FIELD OF ART

The present invention relates to a method and an apparatus for manufacturing metal plate chip resistors.

BACKGROUND ART

Metal plate chip resistors composed of a resistive metal element in the form of an alloy plate and electrode films formed over the ends of the resistive element are conventionally used for detection of electrical current or other purposes. For such purposes, the resistance of the chip resistors is set at a relatively low level, such as from several millions to one ohm. There have been demands for higher accuracy and lower resistance of metal plate chip resistors, and Patent Publication 1 discloses an apparatus intended to meet such demands.

Patent Publication 1 discloses an apparatus for adjusting the resistance of a metal plate resistor including: probes to be contacted with electrodes formed over the ends of a metal plate for measuring the resistance of the metal plate; a grind stone disc for notching the metal plate to adjust the resistance; a rotary mechanism and a transfer mechanism for rotating and advancing the grind stone disc; means for injecting a gas against the metal plate during the notching process; and an instantaneous adjustment-stop mechanism for stopping the notching by detaching the grind stone disc from the metal plate when the metal plate is adjusted to have a desired resistance.

In this apparatus for adjusting the resistance, the grind stone disc is alternately rotated in forward and reverse directions for notching the metal plate.

Another trimming apparatus for metal plate resistors is disclosed in Patent Publication 2, which includes a pulse excited laser apparatus; an irradiating optical part which focuses the laser beam generated by the pulse excited laser apparatus and irradiates a resistive metal element for cutting the same; irradiation positioning means for positioning the irradiation of laser beam from the irradiating optical part; measuring means for measuring the resistance of the resistive metal element during cutting; and means for preventing adhesion of debris which prevents, at a site where the resistive metal element is supported, adhesion of debris produced by cutting the resistive metal element.

Patent Publication 3 discloses in paragraphs [0036] and [0037] a method for giving a desired resistance to a jointed body (a metal plate joined with electrodes), which has been cut into a predetermined length, by removing part of the side or top surface portion of the jointed body by a sand blasting machine or various cutting machines, such as a laser machining device, while the resistance is monitored.

Patent Publication 1: JP-3873819-B
Patent Publication 2: JP-3525815-B
Patent Publication 3: JP-2007-103976-A

SUMMARY OF THE INVENTION

In the method or apparatus disclosed in Patent Publications 1 to 3, the metal plate provided with electrodes is subjected to notching, formation of cutting portions, or partial removal.

However, these steps are complicated, and cause reduced productivity and laborsome production control. In addition, the resistance tends to vary as the production steps proceed, which results in difficulty in achieving a desired resistance. Further, when the laser beam is used as disclosed in Patent Publications 2 and 3, hot spots tend to be formed on the metal plate resistor, and its performance is deteriorated by hot spots.

The present invention aims to solve the above problems. It is an object of the present invention to provide a method and an apparatus for manufacturing metal plate chip resistors that allow production of metal plate chip resistors having a low resistance with high accuracy and a high yield through a relatively simple process.

According to the present invention, the above problems are solved by the following means:

(1) A method for manufacturing metal plate chip resistors comprising the steps of:

forming a protective film longitudinally along a center of a resistive metal plate strip;

forming an electrode film along each longitudinal edge of said resistive metal plate strip;

cutting said resistive metal plate strip transversely in a predetermined width corresponding to a width of one chip resistor to obtain a resistive metal plate chip;

measuring a resistance of said resistive metal plate chip; and performing a calculation using a measured value to work out a cutting width in which said resistive metal plate strip is to be cut transversely in a next cutting step so as to obtain a resistive metal plate chip of a desired resistance;

wherein said method is characterized by the steps of:

cutting said resistive metal plate strip transversely in said cutting width obtained from said step of performing a calculation;

measuring a resistance of a resulting resistive metal plate chip; and performing a calculation using a measured resistance to work out a cutting width in which said resistive metal plate strip is to be cut transversely in a next cutting step so as to obtain a resistive metal plate chip of a desired resistance.

(2) A method for producing metal plate chip resistors comprising the steps of:

forming a protective film longitudinally along a center of a resistive metal plate strip;

forming an electrode film along each longitudinal edge of said resistive metal plate strip;

cutting said resistive metal plate strip transversely in a predetermined width corresponding to a width of one chip resistor to obtain a resistive metal plate chip;

measuring a resistance of said resistive metal plate chip; and performing a calculation using a measured value to work out a cutting width in which said resistive metal plate strip is to be cut transversely in a next cutting step so as to obtain a resistive metal plate chip of a desired resistance;

wherein said method is characterized by the steps of:

cutting said resistive metal plate strip transversely twice each in said width obtained from said step of performing a calculation;

measuring a resistance of each of resulting two resistive metal plate chips and working out an average;

performing a calculation using said average to work out a cutting width in which said resistive metal plate strip is to be cut transversely in a next cutting step so as to obtain a resistive metal plate chip of a desired resistance.

(3) An apparatus for manufacturing metal plate chip resistors, said apparatus cutting, transversely in a predetermined width, a resistive metal plate strip having been provided with a protective film between elect rode films extending along edges of said strip, said apparatus comprising:

cutting means for cutting a resistive metal plate strip transversely to obtain a resistive metal plate chip;

measuring means for measuring a resistance of said resistive metal plate chip;

calculating means for performing a calculation using said resistance measured by said measuring means to work out a cutting width in which said resistive metal plate strip is to be cut transversely so as to obtain a resistive metal plate chip of a desired resistance; and cutting width adjusting means for making an adjustment so that said resistive metal plate strip is to be cut transversely in said cutting width calculated by said calculating means.

According to the method for manufacturing metal plate chip resistors of the present invention, a resistive metal plate strip previously provided with electrode films and a protective film (intermediate product strip) is cut transversely in a cutting width corresponding to a width of one chip resistor (initial setting value) to obtain a resistive metal plate chip (worked product chip), the resistance of this worked product chip is measured, and a calculation is performed using the measured value to work out the cutting width in which the intermediate product strip is to be cut transversely in the next cutting step so as to obtain a worked product chip of a desired resistance.

Next, the intermediate product strip is cut transversely once or twice each in the calculated cutting width to obtain one or two worked product chips, the resistance of each worked product chip is measured, and the cutting width for the next cutting step is calculated using this one measured resistance or an average of the two measured resistances. Thereafter, worked product chips are manufactured by repeating the cutting step, the resistance measuring step, and the cutting width calculating step, and the worked product chips having resistances within the allowable range are made into metal plate chip resistors.

According to the present invention, the cutting width in which the intermediate product strip is to be cut transversely is constantly calibrated with reference to the resistance of the worked product chip obtained in the previous step. Thus, resistances of the worked product chips fall within an allowable range with extremely high accuracy, and the worked product chips are made into metal plate chip resistors with an extremely high yield. Accordingly, these troublesome steps are escaped by this invention. These troublesome steps are notching, formation of cutting portions, or partial removal of a resistive metal plate as required in the prior art. This invention realizes manufacture of metal plate chip resistors of high accuracy and low resistance through a relatively simple process.

The apparatus for manufacturing metal plate chip resistors according to the present invention includes a calculating means for performing a calculation using the resistance measured by the measuring means to work out a cutting width in which the intermediate product strip is to be cut transversely so as to obtain a worked product chip of a desired resistance, and an adjustment is made by cutting width adjusting means so that the intermediate product strip is to be cut transversely in the cutting width calculated in the calculating means.

With the apparatus of the present invention, the cutting width in which the intermediate product strip is to be cut in the next step is calculated and calibrated based on the resistance of the worked product chip obtained in the previous step. Thus, the present invention dispenses with complicated devices, such as those for notching, formation of cutting portions, or partial removal of a resistive metal plate as required in the prior art, and allows the resistances of the worked product chips to fall within an allowable range with extremely high accuracy. Further, the yield of the metal plate chip resistors produced from the worked product chips is remarkably improved.

DESCRIPTION OF REFERENCE NUMERALS

Figure 1:
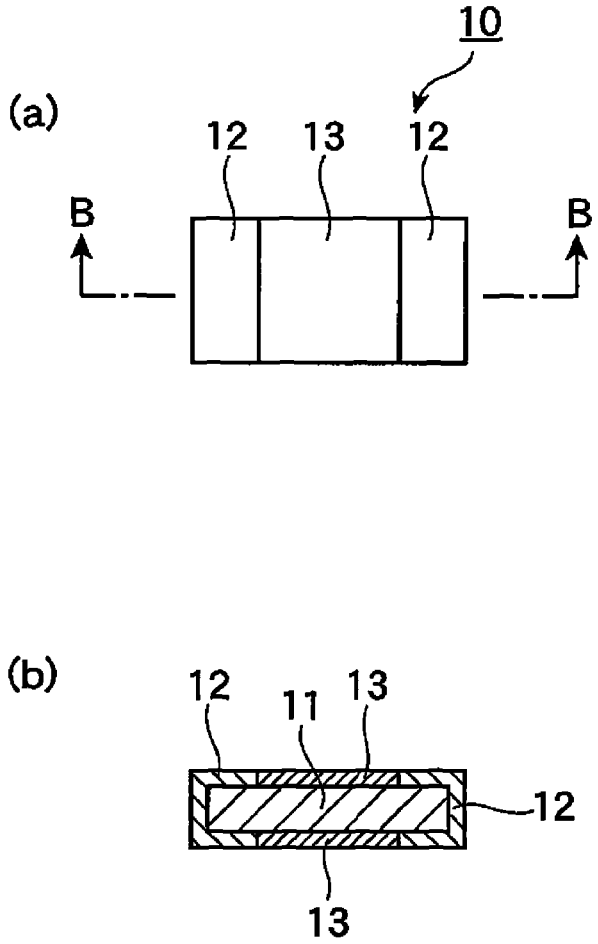
FIGS. 1(*a*) and 1(*b*) are plan and cross-sectional views, respectively, of a metal plate chip resistor.

10 Metal plate chip resistor
11 Resistive metal plate
12 Electrode film
13 Protective film
14 Intermediate product strip
20 Apparatus for manufacturing metal plate chip resistors
21 Cutting mold (Cutting means)
22 Ohm meter (Measuring means)
23 Control device with calculating part
26 Conveyance device (Cutting width adjusting means)
27 Position adjusting device (Cutting width adjusting means)
$A_n$ Worked product chip obtained from the nth cutting
$R_n$ Resistance of $A_n$
$W_n$ Cutting width for the nth cutting

PREFERRED EMBODIMENTS OF THE INVENTION

The present invention will now be explained with reference to an example taken in conjunction with the drawings, which do not limit the present invention.

FIGS. 1(*a*) and 1(*b*) are plan and cross-sectional views, respectively, of a metal plate chip resistor 10 manufactured according to the present invention. The metal plate chip resistor 10 is composed of a resistive metal plate 11 made of an alloy, an electrode film 12 formed over each end of the plate 11 from its top surface to its rear surface, and protective films 13 formed between the electrode films 12 provided on the ends.

For example, the resistive metal plate 11 may be made of an alloy which consists of Cu and Ni. The electrode film 12 may be made by plating a Cu film, a Ni film, and a Sn film in this order. The protective film 13 may be formed by applying an epoxy resin paste to the resistive metal plate by screen printing.

Figure 2:
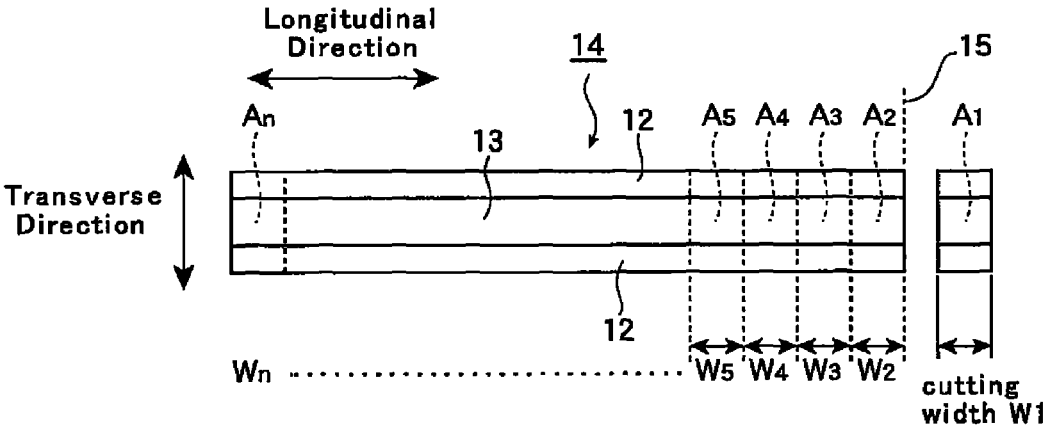
FIG. 2 is a plan view of an intermediate product strip used in the present invention.

FIG. 2 is a plan view of an intermediate product strip 14 used in the method of manufacturing the chip resistors 10 according to the present invention. The intermediate product strip 14 is a resistive metal plate strip 11 provided with electrode films 12 formed longitudinally along each edge of the strip 11, and protective films 13 formed longitudinally along the center of the strip on front and rear surfaces.

In the present invention, the intermediate product strip 14 is cut transversely as shown by dotted lines 15 in predetermined cutting widths $W_n$ into worked product chips $A_n$. The resistance of a worked product chip $A_n$ may be lowered by expanding the cutting width $W_n$, and increased by narrowing the cutting width $W_n$.

Incidentally, a worked product chip $A_n$ is made into a metal plate chip resistor 10 as a finished product through some finishing steps.

Figure 3:
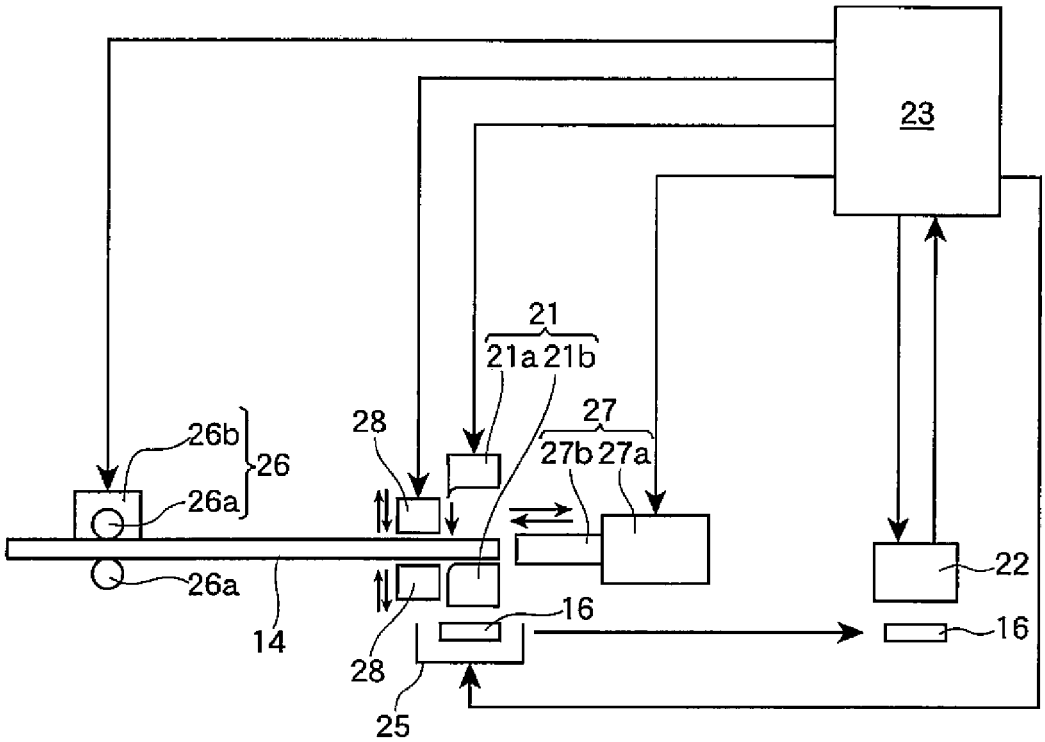
FIG. 3 is a diagram showing the structure of an apparatus for manufacturing metal plate chip resistors according to the present invention.

FIG. 3 is a diagram showing the structure of an apparatus for manufacturing metal plate chip resistors according to the present invention.

The apparatus 20 for manufacturing metal plate chip resistors includes as main parts a cutting mold 21 as cutting means for cutting the intermediate product strip 14 transversely to obtain a worked product chip $A_n$, an ohm meter 22 for measuring the resistance of the worked product chip $A_n$, a control device 23 having a calculating part for performing a calculation using the resistance measured by the ohm meter 22 to work out the cutting width in which the intermediate product strip 14 is to be cut so as to obtain a worked product chip of a desired resistance, and cutting width adjusting means for making an adjustment so that the intermediate product strip 14 is cut transversely in the cutting width calculated by the calculating part.

The cutting mold 21 may be composed of a moving part 21*a* and a follower part 21*b*. The moving part 21*a* has a cutting blade, and is positioned above the intermediate product strip 14, whereas the follower part 21*b* is positioned on the side of the strip opposite to the moving part 21*a*, and functions also as a table for receiving a worked product chip $A_n$ immediately after it is cut off.

The cutting mold 21 is adapted so that the moving part 21*a* makes vertical movement under the control of the control device 23 to cut the intermediate product strip 14 with the cutting blade to give a worked product chip $A_n$.

The ohm meter 22, though not shown in detail, may be composed of a body part and a pair of measurement terminals connected to the body part with cords. The pair of measurement terminals are brought into contact with the electrode films 12 on the ends of a worked product chip $A_n$ to measure the resistance of the worked product chip $A_n$, and the measured data are transmitted from the body part to the calculating part of the control device 23. Incidentally, the measurement of the resistance by means of the pair of measurement terminals may be made while the worked product chip $A_n$ still rests on the follower part 21*b* of the cutting mold 21, or after the worked product chip $A_n$ is transferred to a predetermined site by means of a carrier 25.

The cutting width adjusting means may be composed (1) solely of a conveyance device 26 which feeds the intermediate product strip 14 to the cutting mold 21, or (2) of the conveyance device 26 along with a position adjusting device 27. The intermediate product strip 14 positioned by means of only the conveyance device 26 or by means of the conveyance device 26 and the position adjusting device 27, is fixed with a fixing device 28 and cut with the cutting mold 21.

(1) When Composed Solely of Conveyance Device 26

The conveyance device 26 may include rollers 26*a* and a drive portion 26*b*. The drive portion 26*b* rotates the rollers 26*a* under the control of the control device 23, and the rollers 26*a* hold the intermediate product strip 14 therebetween to feed the same forward. The feed length is directly applied as the cutting width.

(2) When Composed of Conveyance Device 26 and Position Adjusting Device 27

The position adjusting device 27 may include a drive portion 27*a* and a variable position axis portion 27*b*. The drive portion 27*a* axially extends or retracts the variable position axis portion 27*b* under the control of the control device 23. In this case, the length of the intermediate product strip 14 fed by the conveyance device 26 is not directly applied as the cutting width, but is finely adjusted by means of the position adjusting device 27.

For example, the variable position axis portion 27*b* is axially extended or retracted by the drive portion 27*a* under the control of the control device 23 to place the tip of the axis portion 27*b* at a predetermined position. The drive portion 26*b* rotates the rollers 26*a* to feed the intermediate product strip, with conveyance device 26 being set to feed at a length that is larger than the maximum allowable cutting width. In the feeding process, when the intermediate product strip contacts the tip of the variable position axis portion 27*b*, the rollers 26*a* of the conveyance device 26 slip on the intermediate product strip, and the feeding of the strip is stopped. At this stop position, the intermediate product strip is cut in the desired cutting width.

The control device 23 may include, though not shown, a data storage part and a calculating part. The data storage part stores the initial setting values, measured data, operational expressions, programs, and the like, and the calculating part performs predetermined processing using these data.

In detail, the initial setting values may include, for example, those used for performing the first cutting step on the intermediate product strip 14. The measured data may include, for example, resistances $R_n$ of the worked product chips $A_n$ measured in sequence. The operational express ions may include, for example, those used for working out, from the resistance $R_n$ of the worked product chip $A_n$ obtained in the previous cutting step, the cutting width $W_{n+1}$ in which the intermediate working strip is to be cut in the next cutting step. The programs may include, for example, those used for controlling each component, such as ohmmeter 22, carrier 25, conveyance device 26, position adjusting device 27, and fixing device 28, to implement each step according to the predetermined flow in the apparatus 20 for manufacturing metal plate chip resistors.

Next, a process for working out a cutting width is explained.

The resistance of a rectangular resistive metal plate of a certain thickness may be calculated according to the theoretical formula (I) below, wherein the cross-section of the electrodes is assumed to be provided in the plane defined by width (W)×thickness (t).

$$R=\rho\cdot\{L/(W\cdot t)\} \qquad \text{Theoretical formula (1)}$$

R: Resistance
ρ: Volume resistivity
L: Length
W: Width
t: Thickness

As initial setting values regarding the cutting width, the minimum allowable value $W_{min}$ and the maximum allowable value $W_{max}$ are input in the data storage part of the control device 23, and from the average of these values $(W_{min}+W_{max})/2$, the cutting width $W_1$ for the first cut is determined. Then a worked product chip is produced in this cutting width $W_1$ and its resistance $R_1$ is measured. Based on the deviation of the resistance $R_1$ from the objective resistance R, the cutting width $W_2$ for the second cut is calculated according to the theoretical formula (1). The cutting width $W_n$ for the second and further cut (nth cut) may be calculated similarly according to the theoretical formula (1) based on the deviation of the measured resistance $R_{n-1}$ of the n−1th worked product chip from the resistance R and the cutting width $W_{n-1}$ for the n−1th cut.

Next, a process for manufacturing metal plate chip resistors by means of the apparatus 20 for manufacturing metal plate chip resistors according to the present invention is explained.

[Production of Intermediate Product Strip]

For the present invention, the step of preparing an intermediate product strip 14 as shown in FIG. 2 is performed as a preliminary step. In this step, on each of the front and rear surfaces of a resistive metal plate strip 11, a protective film 13 is formed longitudinally along the center of the strip, and an electrode film 12 is formed along each edge of the strip on the front and rear surfaces as well as the side face where the protective film 13 is not formed.

[Input of Initial Values]

Next, initial values are input to the control device 23 of the apparatus 20 for manufacturing metal plate chip resistors. Such initial values may include, for example, the minimum allowable cutting width, the maximum allowable cutting width, the initial setting value of the cutting width, the frequency of resistance measurement, the frequency of change in cutting width, the objective resistance, and the number of cuttings to be made to one intermediate product strip.

[Production of First Worked Product Chip]

After the input of the initial values, the first worked product chip is to be produced.

The position adjusting device 27 axially extends or retracts the variable position axis portion 27*b* under the control of the control device 23 according to the initially-set cutting width $W_1$ to place the tip of the axis portion 27*b* in a predetermined position. The drive portion 26*b* of the conveyor device 26, under the control of the control device 23, drives the rollers 26*a* to feed the intermediate product strip 14 forward. When the leading end of the strip contacts the variable position axis portion 27*b* of the position adjusting device 27, the rollers 26*a* slip on the intermediate product strip 14 to allow the strip to stop.

Then the intermediate product strip 14 is clamped with the fixing device 28 from the above and below to fix, and the moving part 21*a* of the cutting mold 21 is moved downwards to cut with its cutting blade the intermediate product strip 14 in the cutting width $W_1$, thereby giving a worked product chip $A_1$.

[Measurement of Resistance]

Then, the moving part 21*a* is moved upwards under the control of the control device 23, and the worked product chip $A_1$ is transferred to a predetermined site by the carrier 25 and subjected to measurement with the ohm meter 22. The ohm meter 22 transmits the measured resistance $R_1$ of the worked product chip $A_1$ to the control device 23, where the resistance $R_1$ is stored in the data storage part.

[Calculation of Cutting Width for Next Cutting Step]

The cutting width $W_2$ for the second worked product chip $A_2$ is calculated in the calculating part of the control device 23, based on the resistance $R_1$ stored in the data storage part, the objective resistance R, and the cutting width $W_1$ of the first worked product chip. The obtained cutting width $W_2$ is stored in the data storage part.

[Frequency 1: Production of Second and Further Worked Product Chips]

In the step of inputting the initial values, when the frequency of resistance measurement is set to 1, and the frequency of change in cutting width is set to 1, each of the second and further worked product chips is produced by the process similar to the above, i.e., the resistance $R_n$ of one worked product chip $A_n$ is measured, the cutting width $W_{n+1}$ in which the intermediate product strip 14 is to be cut in the next cutting step is calculated, and stored in the data storage part.

That is, in the production process of a worked product chip $A_n$, the intermediate product strip 14 is fed forward by the conveyance device 26, and when the leading end of the strip contacts the variable position axis portion 27*b* of the position adjusting device 27, the rollers 26*a* slip on the intermediate product strip 14 to allow the strip to stop at a predetermined position. The intermediate product strip 14 is then clamped with the fixing device 28 from the above and below to fix, and cut with the cutting mold 21 in the cutting width $W_n$. The resulting worked product chip $A_n$ is subjected to measurement with the ohm meter 22, and the obtained resistance $R_n$ is transmitted to the control device 23. In the calculating part of the control device 23, the cutting width $W_{n+1}$ for the n+1th worked product chip $A_{n+1}$ is calculated and stored in the data storage part. The above steps are repeated for each worked product chip for the number of cutting times input as the initial value.

[Frequency 2: Production of Second and Further Worked Product Chips]

In the step of inputting the initial values, when the frequency of resistance measurement is set to 2 and the frequency of change in cutting width is set to 2, the second and further worked product chips are produced by cutting the intermediate product strip 14 in a fixed cutting width $W_n$ to give worked product chips $A_n$ and $A_{n+1}$. The resistances $R_n$ and $R_{n+1}$ of the worked product chips $A_n$ and $A_{n+1}$, respectively, are measured individually, and stored in the data storage part. The average of the two resistances $R_n$ and $R_{n+1}$ is calculated, from which the cutting width $W_{n+2}$ is worked out in the calculating part in the control device 23. The two worked product chips $A_{n+2}$ and $A_{n+3}$ to be produced following the worked product chips $A_n$ and $A_{n+1}$ are cut off from the intermediate product strip 14 in the same cutting width $W_{n+2}$. The above steps are repeated for every two worked product chips for the number of cutting times input as the initial value.

The worked product chip $A_n$ thus obtained is made into a finished product, metal plate chip resistor 10, through some finishing steps.

Figure 4:
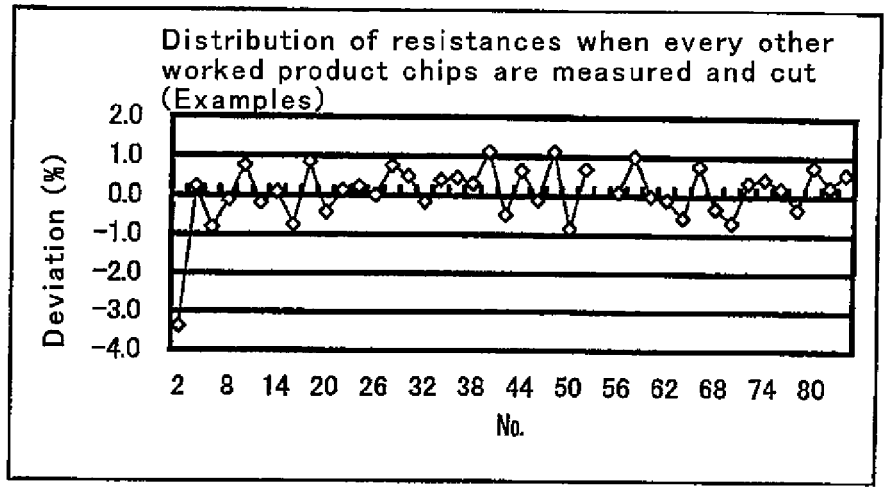
FIG. 4(*a*) is a graph showing the distribution of resistances of worked product chips manufactured according to an example of the present invention, and FIG. 4(*b*) is a graph showing the distribution of resistances of worked product chips cut in the same width as a comparative example.
Figure 4:
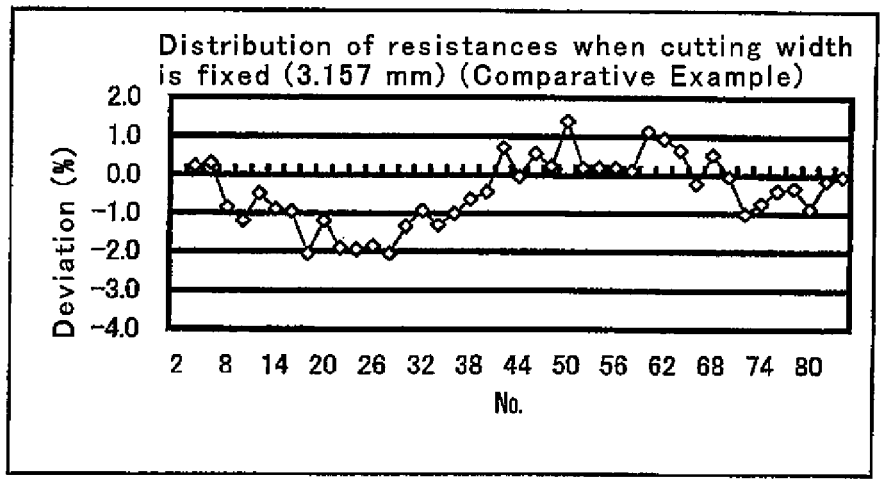

Referring to FIGS. 4(*a*) and 4(*b*), accuracy of resistance of the metal plate chip resistors manufactured by the method of the present invention is discussed.

FIG. 4(*a*) is a graph showing the deviation, from the objective resistance, of the resistance of every other worked product chip produced by the present method, with the frequencies of resistance measurement and change in cutting width being set to 1.

Here, the allowable range of resistance is the objective resistance±1.0%, and the resistances of almost all, except for a few, of the worked product chips fall within the allowable range. Such results clearly show that the method of the present invention allows the resistances of worked product chips to fall within the allowable range with extremely high accuracy, so that the yield of the metal plate chip resistors produced from the worked product chips is also improved remarkably.

FIG. 4(*b*) is a graph showing a comparative example, wherein the deviation, from the objective resistance, of the resistance of every other worked product chip cut off from one intermediate product strip in a fixed cutting width of 3.157 mm is shown. When the worked product chips are produced in a fixed cutting width, many of the worked product chips fall out of the allowable range of the objective resistance±1.0%, which naturally results in a low yield of the metal plate chip resistors produced from the worked product chips.

What is claimed is:

1. A method for manufacturing metal plate chip resistors comprising the steps of:

providing a resistive metal plate strip with a protective film on each of a front and rear surfaces of said strip longitudinally along a center thereof;

forming an electrode film along each longitudinal edge of said resistive metal plate strip, to thereby obtain an intermediate product strip;

cutting said intermediate product strip transversely twice in a width to obtain first and second resistive metal plate chips, measuring a resistance of each of said first and second resistive metal plate chips and working out an average, performing a calculation using said average to work out a cutting width of said intermediate product strip to be cut transversely in a subsequent cutting step so that resulting third and fourth resistive metal plate chips will have a desired resistance, and repeating the steps of cutting, measuring, and performing a calculation for subsequent resistive metal plate chips, wherein said intermediate product strip is cut transversely in said cutting width determined in previous step of performing a calculation.

2. The method according to claim 1, further comprising the step of making said resistive metal plate chip into a metal plate chip resistor.

3. The method according to claim 1, wherein the steps of cutting, measuring, and performing a calculation are made with an apparatus comprising:

cutting means for cutting said intermediate product strip transversely to obtain a resistive metal plate chip, measuring means for measuring a resistance of said resistive metal plate chip, calculating means for performing a calculation using said resistance to work out a cutting width of said intermediate product strip to be cut transversely in a subsequent cutting step so that a resulting resistive metal plate chip will have a desired resistance, and cutting width adjusting means for making an adjustment so that said intermediate product strip is to be cut transversely in said subsequent cutting step in said cutting width determined by said calculating means.

4. The method according to claim 3, wherein said cutting width adjusting means comprises a conveyance device for feeding said resistive metal plate strip by said cutting width toward said cutting means.

5. The method according to claim 3, wherein said cutting width adjusting means comprises a conveyance device for feeding said resistive metal plate strip toward said cutting means, and a position adjusting device for stopping the resistive metal plate strip fed by said conveyance device in a predetermined position to finely adjust to a desired cutting width.

* * * * *